US005826402A

United States Patent [19]

Savage

[11] Patent Number: 5,826,402

[45] Date of Patent: Oct. 27, 1998

[54] PRE-WRAPPED GIFT BOX

[76] Inventor: Tommy R. Savage, 14100 Montfort Dr. #2248, Dallas, Tex. 75240

[21] Appl. No.: 713,894

[22] Filed: Sep. 17, 1996

Related U.S. Application Data

[60] Division of Ser. No. 242,476, May 13, 1994, Pat. No. 5,584,429, which is a continuation-in-part of Ser. No. 15,209, Mar. 25, 1993, which is a continuation-in-part of Ser. No. 933,493, Aug. 21, 1992, Pat. No. 5,245,815.

[51] Int. Cl.[6] ..... B65B 5/04; B65B 43/26; B65B 51/06; B65B 69/00

[52] U.S. Cl. ..... 53/449; 53/458; 53/491; 493/110; 493/111; 493/116

[58] Field of Search ..... 53/449, 456, 458, 53/491, 410; 493/110, 111, 116; 229/87.19, 923, 37, 132

[56] References Cited

U.S. PATENT DOCUMENTS

| | | | |
|---|---|---|---|
| 2,479,456 | 8/1949 | Arthur | 229/87.19 X |
| 3,460,738 | 8/1969 | Adams, Jr. et al. | 229/37 |
| 4,088,263 | 5/1978 | Michetti | 229/132 |

*Primary Examiner*—Horace M. Culver
*Attorney, Agent, or Firm*—Irell & Manella LLP

[57] ABSTRACT

The present invention provides a method of forming a pre-wrapped gift package which appears to have been hand wrapped. The method includes forming a sheet of box construction material with decorative paper affixed thereto into a flattened box tube by joining ends thereof. The box construction material is properly creased and provided with flaps so that a consumer may erect the flattened box tube into an open box so that the end flaps form ends of the box and the decorative paper forms a pair of paper flaps which may be overlapped and secured. A volume sizer is provided in the form of creased box construction material which, when erected, provides an illustration of the volume made available when the pre-wrapped gift box is erected. Box loading devices, particularly useful for shirt box sized packages, are provided in the form of inner sleeves and mechanical devices into which the gift is placed before insertion into the pre-wrapped gift box. Side loading, top opening configurations provide additional support for the pre-wrapped appearance. Gathering triangles are provided between flaps to aid in the closing of the flaps to form the pre-wrapped gift package.

4 Claims, 10 Drawing Sheets

FIG. 1
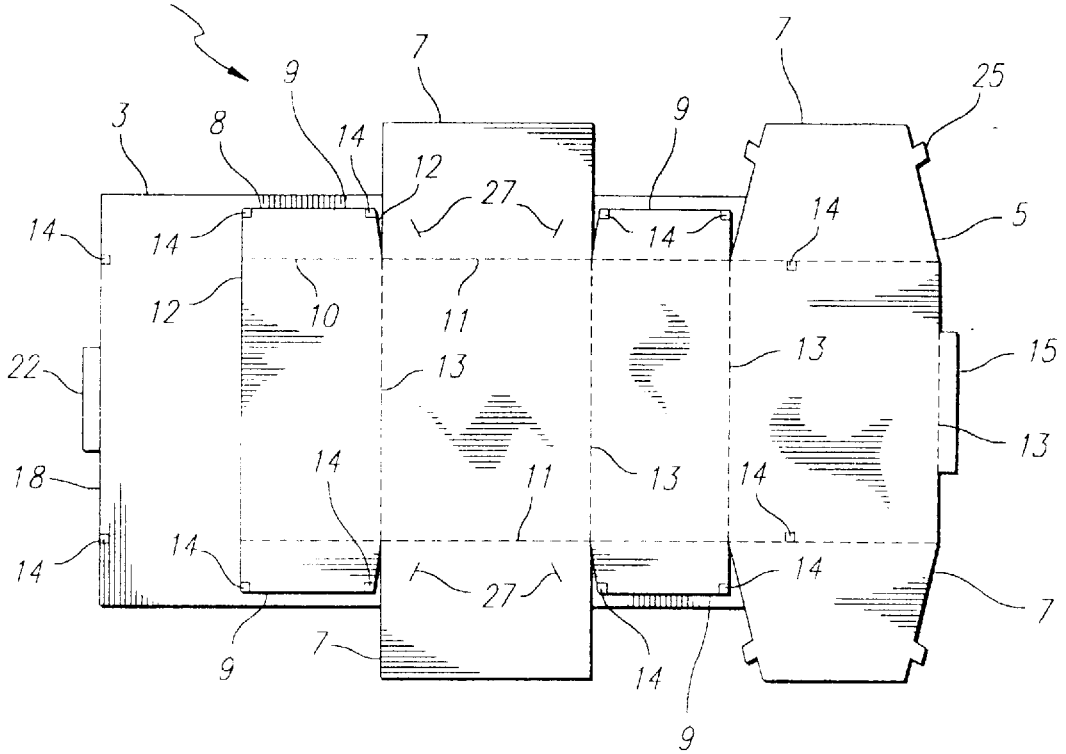
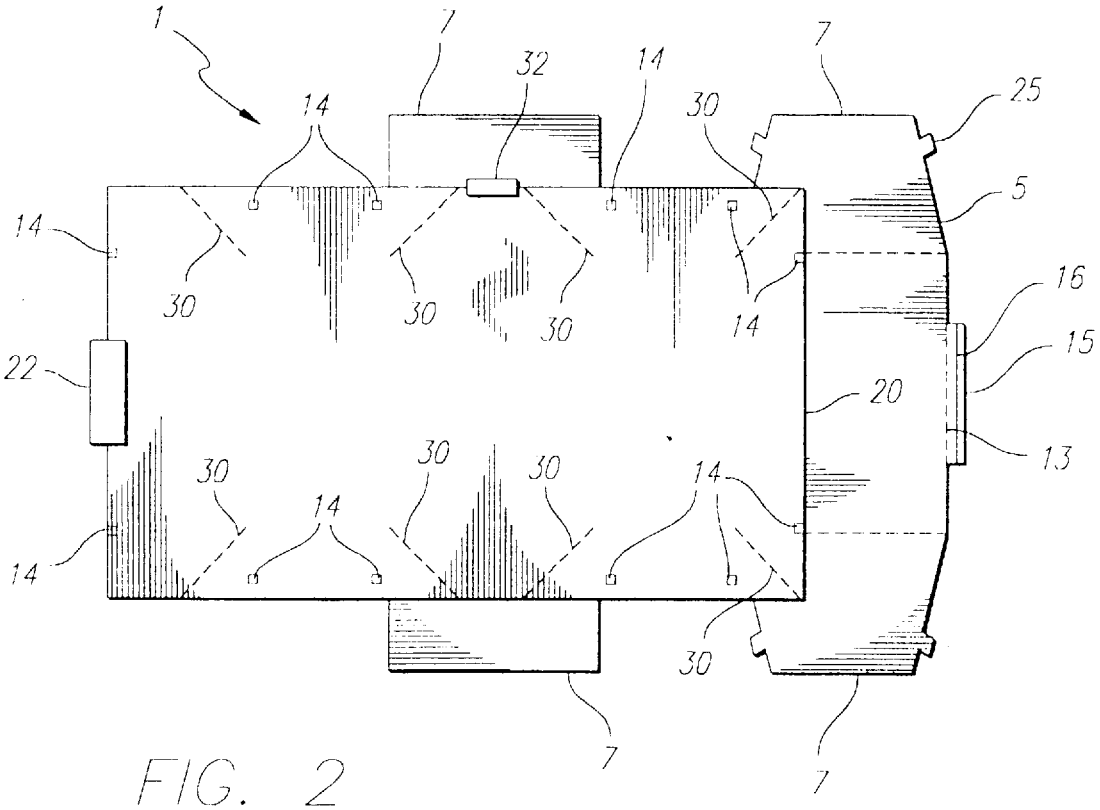
FIG. 2

FIG. 3
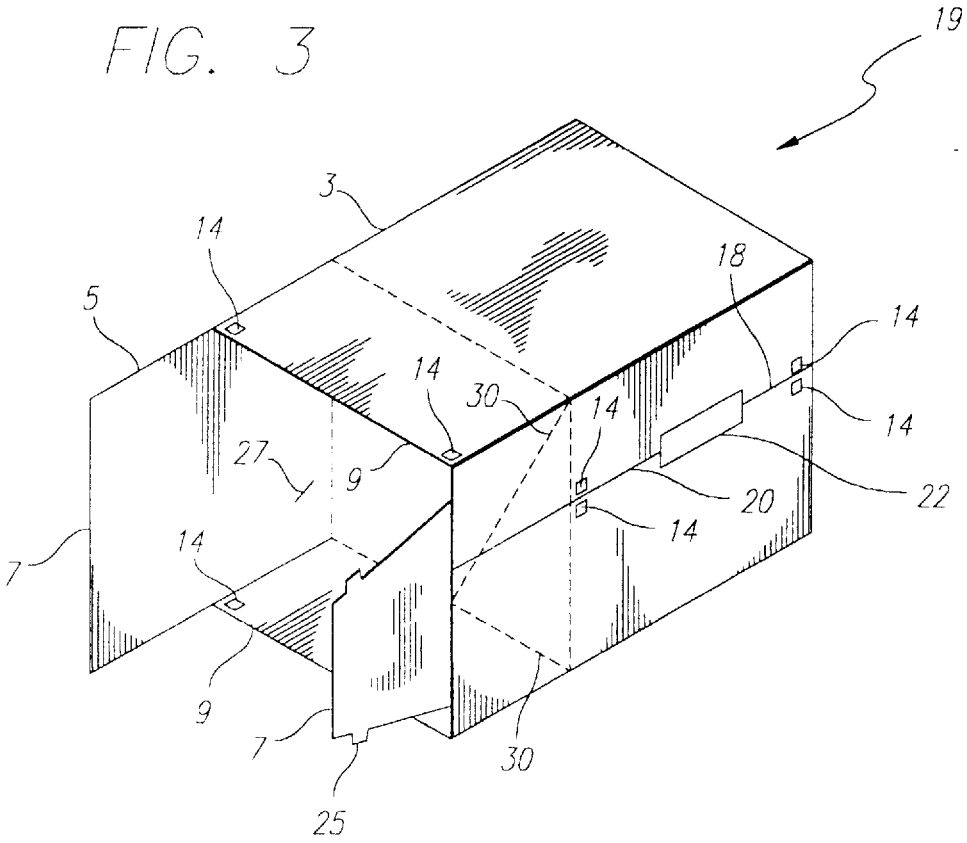
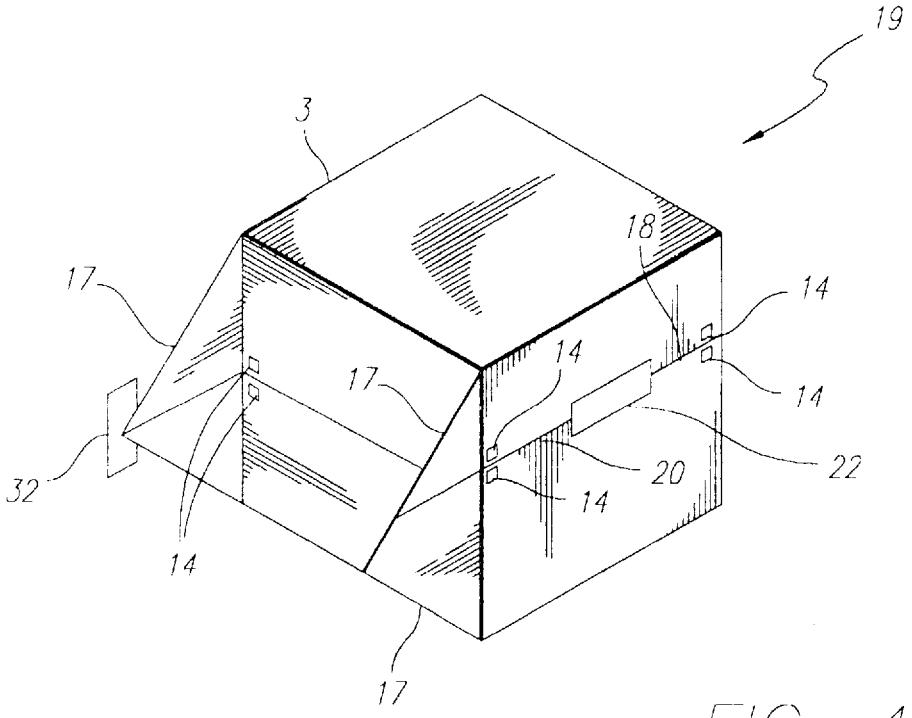
FIG. 4

PRE-WRAPPED GIFT BOX

CROSS REFERENCE TO RELATED APPLICATIONS

This is a divisional of application Ser. No. 08/242,476 filed on May 13, 1994, now U.S. Pat. No. 5,584,429 which is a continuation-in-part application of Ser. No. 08/015,209 filed Mar. 25, 1993 now pending, which is a continuation-in-part application of Ser. No. 07/933/493, filed on Aug. 21, 1992 issued as U. S. Pat. No. 5,245,815.

BACKGROUND OF THE INVENTION

1. Field of the Invention

The present invention relates generally to the field of gift wrapped packages and in particular to a pre-wrapped gift box which, when assembled, has the appearance of a hand wrapped gift package.

2. Description of the Prior Art

The gift wrapping of packages is a reoccurring event which is often a time consuming and frustrating experience. It is difficult, without considerable experience, to properly estimate and accurately cut the correct amount and shape of wrapping paper needed. It is also difficult to tightly and neatly attach the paper to the box. To avoid these problems of hand wrapping packages, a gift wrapping service may be employed, however, this is a relatively expensive alternative.

Pre-wrapped gift packaging is presently known, but its pre-wrapped nature is apparent. That is, the gift receiver may easily see that the gift was not personally gift wrapped. For example, packages consisting of a pre-wrapped open box bottom and a pre-wrapped box cover are commercially available. Also, packages with printed external surfaces are presently sold, in theory, eliminating the need for separate wrapping. Similarly, boxes with decorative wrapping paper loosely attached are known.

But the giving of gifts in packages which are clearly and noticeably not hand wrapped may convey a lack of caring or consideration. This is opposite to the sentiment normally sought to be conveyed by the giving of a gift. What is needed is a pre-wrapped gift package which, when assembled, provides the pleasing appearance of a hand wrapped gift wrapped box and which maintains this appearance upon being opened.

Many gifts are boxed and wrapped in gift wrap departments in stores. The procedure currently used for wrapping gifts is labor intensive, time consuming, and wastes paper. What is needed is a gift box and related tools that make it easy for a gift giver, and/or a wrapper in a gift wrap department, to construct and load a gift into a gift wrapped box.

SUMMARY OF THE INVENTION

The preceding and other shortcomings of the prior art are addressed and overcome by the present invention which provides, in a first aspect, a pre-wrapped box substrate including front, bottom, back and top panels for forming the front, bottom, back and top of a box, the front and bottom, bottom and back, back and top panels being connected to each other along one edge by a bendable crease, a front lip connected to the top panel along one edge by a bendable crease and detachably connectable a surface of the front panel to form a box tube, pairs of front, bottom, back and top flaps connected to the front, bottom, back and top panels along one edge by bendable creases, said pairs of flaps sized to form box ends to seal the box tube to form a side loading, top opening box.

In another aspect, the present invention provides a method of making a side loading, top opening pre-wrapped gift box by forming a box substrate having front, bottom, back and top panels in which the front and bottom, bottom and back, back and top panels being connected to each other along one edge by a bendable crease and having pairs of front, bottom, back and top flaps connected to the front, bottom, back and top panels along one edge by bendable creases, detachably connecting a front lip, connected to the top panel along one edge by a bendable crease, to a surface of the front panel to form a box tube, and applying adhesive to the substrate for connecting one of the front, bottom and back flaps of each pair to form a box end during box loading while permitting the top flap to easily be removed from said box end during top opening by rotating the top panel about the bendable crease connecting the top panel to the back panel.

In another aspect, the present invention provides a box loading device for loading a compressible object into an erected box tube including an object compartment sized for convenient insertion into which the compressible object may be placed, the object compartment being sized for convenient insertion into an open end of the erected box tube, and cantilever support means for supporting the object compartment from an end thereof to permit convenient insertion into and removal of the object compartment from the open end of the erected box tube.

In a further aspect, the present invention provides a volume sizer for use with a pre-wrapped gift package kit, the volume sizer including a substrate, and a three sided box hinged to the substrate to lie flat on the surface of the substrate until needed, the three sided box forming a four sided box with the substrate when the erected, the volume of the four sided box representing the interior volume of the pre-wrapped gift package.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 1 is a top plan view of a partially assembled box tube including a flat sheet of box construction material, cut and creased for folding, overlying a flat sheet of gift wrapping attached thereto in accordance with the present invention.

FIG. 2 is a top plan view of the attached sheets of box construction material and wrapping paper shown in FIG. 1 which have been rotated to show the wrapping paper on top.

FIG. 3 is an isometric view of a pre-wrapped package formed from a box tube with end flaps on one end in the open position.

FIG. 4 is the pre-wrapped package shown in FIG. 3 after the end flaps have been folded and the folded end portions of the wrapping paper have been creased.

DETAILED DESCRIPTION OF THE PREFERRED EMBODIMENT

Figure 5:
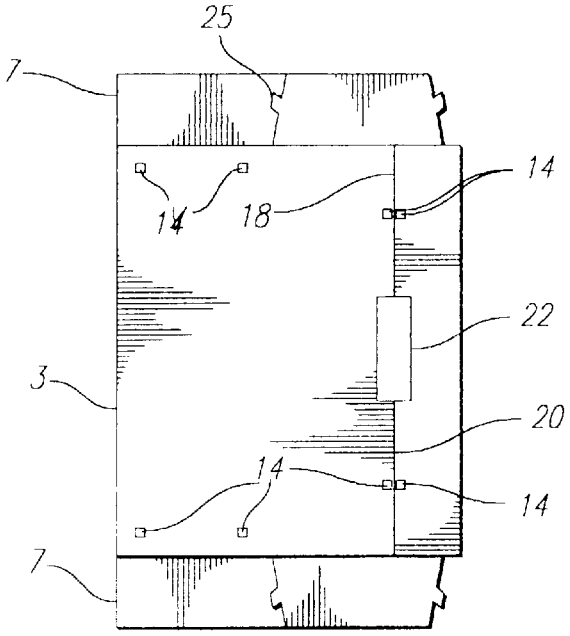
FIG. 5 is a top plan view of the box tube shown in FIGS. 1 and 2 after joining of the joint sides.

The present invention provides an easily formed, pre-wrapped package having the pleasing appearance of a hand wrapped box. Referring to FIGS. 1 and 2, a first embodiment of the invention includes a generally rectangular sheet 1 of box construction material overlying a piece of wrapping paper 3 affixed thereto. Sheet 1 may be a die cut and creased piece of cardboard or other similarly formed thin sheet of material suitable for gift box construction. Sheet 1 is formed to have body 5, four major end flaps 7, and four minor end flaps 9. Two major end flaps 7 and two minor end flaps 9 are alternately located along each long or flap side of body 5, like sized end flaps opposing each other.

Sheet 1 is creased in several places to facilitate its being folded into a closed box. Horizontal or flap creases 11 define the juncture of body 5 with end flaps 7 and 9 and are the lines along which end flaps 7 and 9 are to be folded. Inner edge 10 of minor end flap 9, for example, lies along horizontal crease 11. Vertical or folding creases 13 form the lines along which body 5 is to be folded and define the width of the sides of the box to be formed.

To leave room for the creased wrapping paper, each minor end flap 9 is slightly narrower at its outer edge 8 than at its crease edge 10. This is done to produce a cleanly wrapped package that appears personally hand wrapped. For convenience of the description herein, the width of each flap will be considered to be its width along horizontal crease 11, e.g. crease edge 10, while the extension of each flap will be the distance from the edge of the flap along the horizontal crease to the flap outer edge, such as outer edge 8. As noted below, if the assembled gift box is to be square in shape, the widths of all major and minor end flaps 7 and 9 will be approximately the same. The extensions of such flaps will be different as described herein below.

End tab 15 is utilized to form a lap joint with the opposite end of body 5 to hold folded body 5 together when the vertical crease 13 adjacent to end tab 15 is folded. The joint may be formed by adhesive material positioned, for example, along tacking strip 16 at the outer edge of end tab 15.

Wrapping paper 3 is affixed to folded body 5 at many points, such as tacking points 14, each of which may be formed by crimping wrapping paper 3 to folded body 5, or by providing a drop of adhesive between wrapping paper 3 and folded body 5, or by any other convenient mechanism which results in the handling and appearance of a hand wrapped box when that box is unwrapped. Rubber cement or other suitable bonding material may be used. In particular, using tacking points between the paper and the box which readily come apart during unwrapping provides a more hand wrapped appearance than a technique, such as surface taping, which would attach the surface of wrapping paper 3 not in contact with folded body 5 to folded body 5. Surface taping between minor end flaps 9 and the edge of wrapping paper 3 adjacent thereto, for example, interferes with unwrapping and imparts the appearance and feel of a non-hand-wrapped package.

Tacking points 14 are positioned as indicated along the inner edges 12 of minor flaps 9 at the intersection thereof with the outer edge 8 of each such flap. Wrapping paper 3 must be adhered along its inner edges 12 to minor end flaps 9 to insure paper flaps 17, as shown in FIG. 4, are properly formed when minor end flaps 9 are folded, as described below. Additional tacking points 14 may be provided wherever convenient or desired for any particular application, except that each major end flap 7 must not be affixed to the portion of wrapping paper 3 adjacent thereto. In addition, it may be convenient to provide tacking points 14 along wrapping paper seam edges 18 and 20, as shown in FIG. 2, to form a seam therebetween.

In addition to tacking points 14 along wrapping paper seam edges 18 and 20, or as an alternate thereto, a small piece of tape, such as tape segment 22, may be used to form the seam. Tape segment 22 may conveniently be used to form the seam between edges 18 and 20 because, during unwrapping, a piece of tape along the paper seam is a normal result of hand wrapping. Tape segment 22 is shown in FIGS. 1 and 2 as attached first to seam edge 18, for convenience. As shown in FIGS. 2 and 3, wrapping paper 3 may be affixed to folded body 5 so that the seam formed by joining wrapping paper seam edges 18 and 20 is conveniently positioned along the side of box 19 which includes major end flaps 7. In this way, when assembled, the seam interferes only minimally with the construction of the box. The seam may also be positioned along the side of the box including a minor flap, but additional tacking points 14 may then be required and the seam may interfere with wrapping paper flaps 17, as shown in FIG. 4.

The relative sizes of major and minor end flaps 7 and 9, and the relationship of the size of wrapping paper 3 with respect thereto, depends on the desired shape of the final box. The box formed from the configurations shown in FIGS. 1, 2, 5 and 6 will be generally rectangular in cross-sectional shape. That is, the shape of the flap end of the box when assembled will be rectangular. A more flattened rectangular box, which may conveniently be used for example as a shirt box, is described below in greater detail with regard to FIGS. 16 through 19. The box shown in FIGS. 3 and 4 is generally square in cross-sectional shape although other shapes including the shirt box size may be employed.

With regard first to such a rectangular box, as shown in FIGS. 1, 2, 5 and 6, the extension of each major flap must be no greater than the width of each minor flap 9 so that the major flaps may be folded over each other, each substantially filling the open area formed at each end of flattened box tube 35 during assembly. Although the extension of the major flaps may be shorter than the width of minor flaps, it may be desirable for them to be substantially equal to the width of the minor flaps so that each such major flap fills the open end of flattened box tube 35 when assembled. This provides maximum box rigidity, but this rigidity may also be improved by using an interlocking or mating flap configuration as described below in greater detail. If the extension of the major flap were greater than the width of minor flap, the major flap would be too long to fold into the box tube end opening.

If the extension of each minor flap is equal to one half the width of each major flap, the end of each minor flap will meet the end of the other minor flap to form a butt joint when the minor flaps are folded over the folded major flaps. If the extension of the minor flaps exceeds one half the width of the major flaps, the minor flaps will overlap each other when the box is assembled. Although the extension of the minor flaps may be less than one half the width of the major end flaps or even be completely eliminated, the assembled box will be stronger and will more closely resemble a hand wrapped box when unwrapped if the extension of the minor flaps is not substantially less than one half the width of the major flaps.

The length of wrapping paper 3 is simply equal to or slightly longer than the sum of the widths of the pairs of minor and major flaps. If the length of wrapping paper 3 is longer than this sum, the seam between wrapping paper seam edges 18 and 20 becomes an overlapping seam with one such edge overlapping the other. An overlapping seam is consistent with hand wrapping techniques. The required width of the paper needed to wrap a rectangular box is related to the size of the box as follows. Wrapping paper 3 must be wide enough to extend past each horizontal crease 11, along each major end flap 7, a distance equal to at least one half of the width of the minor flap. It is preferable that the paper does not extend past each horizontal crease 11 more than a distance equal to half the width of the major flaps so that wrapping paper flaps 17, described below, may be made neatly without unnecessary overlapping of folded paper.

With regard to a square box, the width of the major and minor flaps are equal because of the square shape of the box. The extension of each major flap must therefore be no greater than its width. Wrapping paper 3 must be wide enough to extend past each horizontal crease 11, along each major end flap 7, a distance equal to one half of the width of the minor flap.

Wrapping paper 3, for either a rectangular or a square shaped box, may extend past each flap crease 11 a distance greater than one half the width of a minor end flap but not more than one half the width of a major end flap to avoid interference when folding paper flaps 17.

Referring now to FIGS. 1 through 6, sheet 1 is folded along creases 13 forming flattened box tube 35 having two pairs of opposing surfaces. End tab 15 along one joint side of body 5 is adhered to the opposite end of body 5 to fix sheet 1 in the box tube shape. Sheet 1 may be alternatively fixed in its tubular shape by omitting end tab 15 and applying tape along the end portions of the joint sides of body 5 while they are being held closely together to form a butt joint.

Figure 6:
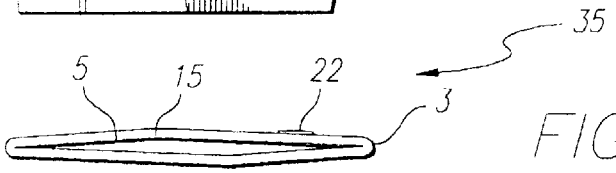
FIG. 6 is an end view of the flattened box tube of FIG. 5.

In either event, after end tab 15 is secured to the opposite edge of folded body 5, or a butt joint is formed in folded body 5, folded body 5 may conveniently be refolded flat along a pair of vertical creases 13 which preferably do not include the joint sides of folded body 5 as shown in FIGS. 5 and 6. In this folded flat condition, slightly exaggerated in the end view shown in FIG. 6 for ease of illustration, the pre-wrapped gift box of the present invention may conveniently be inserted into a transparent plastic bag and header assembly and shipped, displayed and sold in a conventional hanging retail sales configuration. This configuration is shown as pre-wrapped gift box kit 53 and described below in greater detail with regard to FIG. 10.

To form flattened box tube 35 shown in FIGS. 5 and 6 into a wrapped gift box, the remaining vertical creases 13 are folded to form an open box tube as shown in FIG. 3. Major end flaps 7 are then folded, one at a time, into the opening of the open box tube to form one end of box 19. After major end flaps 7 have been folded into the tube formed by folded body 5, minor end flaps 9 are folded inward to rest on the surface formed by folded major end flaps 7. Wrapping paper flaps 17, as shown in FIG. 4, are formed by the folding of minor end flaps 9. Wrapping paper flaps 17 are creased, folded together and taped, completing the formation of the pre-wrapped gift box. In an alternate embodiment, wrapping paper 3 may be pre-creased along pre-crease lines 30 as shown in FIG. 2.

Tape segment 32 may conveniently be pre-attached to one such wrapping paper flap 17 as shown in FIG. 4 between pre-crease lines 30 so that completion of each side of the gift box is accomplished by taping tape segment 32 on one wrapping paper flap 17 directly to the top or display surface of the mating wrapping paper flap 17. After one side of box 19 has been formed from flattened box tube 35 by folding and taping, the gift or other object may be inserted in box 19 which is then closed by folding and taping the open end of the box tube in the same manner. When completed, box 19 has the appearance of a gift wrapped package, indistinguishable from boxes personally wrapped with gift paper. When box 19 is opened, the hand wrapped appearance of box 19 is maintained.

Although one major flap may simply be folded in on the next major flap, there is a substantial advantage in rigidity and strength of the resulting box 19 if interlocking major end flaps as shown in FIGS. 1, 2, 3, and 5 are used. Referring again to FIG. 1, each pair of major end flaps 7 forming one end of box 19 may be made to interlock with each other. In particular, one such major flap may be fitted with extension tabs 25 while the other major flap includes mating tab slots 27. When box 19 is being assembled from flattened box tube 35, as shown in FIGS. 5 and 6, the major end flap 7 including mating tab slots 27 is folded first. Then the other major end flap, which includes extension tabs 25, is folded over. Extension tabs 25 are then inserted in mating tab slots 27 interlocking the major flaps together. Tabs 25 and slots 27 are the presently preferred means of interlocking the major end flaps in this embodiment of the invention, but other male/female interlocking configurations may be utilized.

Approximate relative dimensions for an exemplar of sheet 1, which may be utilized to form boxes incorporating principles of the present invention, are shown below in Table 1.

TABLE 1

| Box Size (a × b × c) | Body a × (2a + 2b) | Minor Flaps | Major Flaps c × b | End Tab |
|---|---|---|---|---|
| 6 × 4 × 4 | 6 × 16 | 2 × 4 | 4 × 4 | 6 × 0.75 |
| 7 × 7 × 7 | 7 × 24 | 3.5 × 7 | 7 × 7 | 7 × 0.75 |
| 8 × 8 × 4 | 8 × 24 | 2 × 4 | 4 × 8 | 8 × 0.75 |
| 9 × 4 × 4 | 9 × 16 | 2 × 4 | 4 × 4 | 9 × 0.75 |
| 9 × 9 × 5.5 | 9 × 29 | 2.75 × 5.5 | 5.5 × 9 | 9 × 0.75 |
| 12 × 6 × 6 | 12 × 24 | 3 × 6 | 6 × 6 | 12 × 0.75 |

Figure 7:
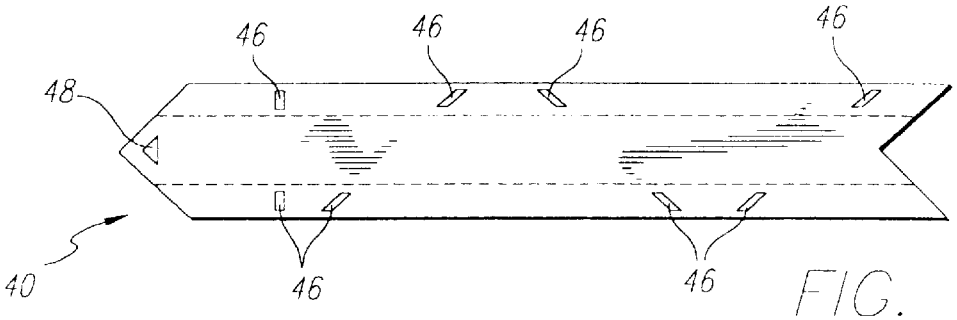
FIG. 7 is a top plan view of a conventional pull bow to be packaged with the flattened box tube of FIGS. 5 and 6 according to the present invention.
Figure 8:
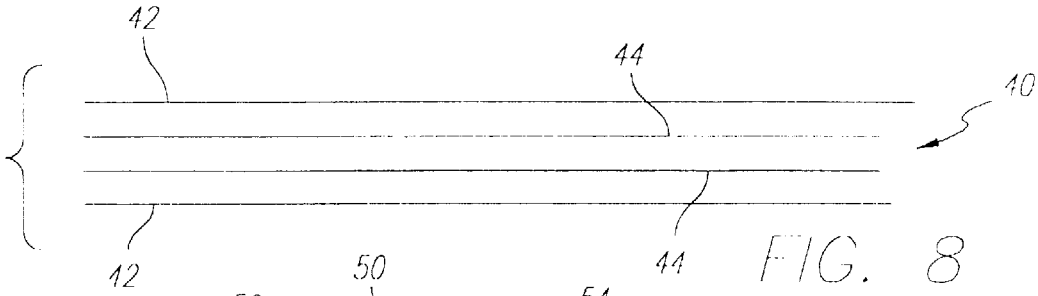
FIG. 8 is an exploded side view of the pull bow of FIG. 7.

The flattened box tube 35 shown in FIGS. 5 and 6 may conveniently be packaged, shipped and displayed in the flattened condition as shown. In the same flattened package, it may be advantageous to provide a ribbon and bow arrangement compatible therewith for use in completing the assembly of box 19. A ribbon and bow arrangement such as pull bow 40 is shown in FIGS. 7 and 8. Various types of pull bows are known, such as the series of pull bows available from 3M Packaging Systems Division, St. Paul, Minn. A pull bow may be shipped in the flattened condition shown in FIG. 7 and conveniently extended into a puffy bow and ribbon arrangement during assembly of the pre-wrapped gift box.

Figure 9:
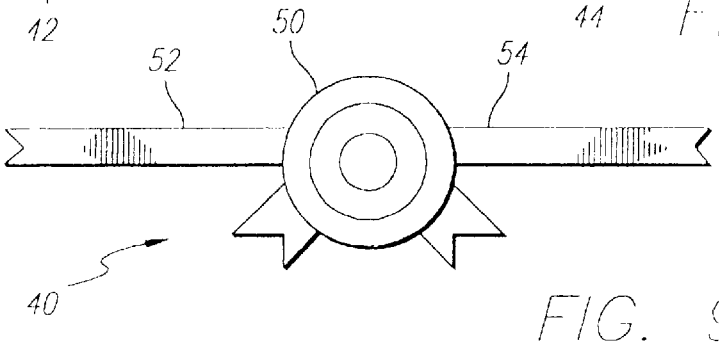
FIG. 9 is a top plan view of the pull bow of FIGS. 7 and 8 after being pulled to form a bow and ribbon arrangement.

The exemplar pull bow shown in FIGS. 7 and 8 includes outer ribbon pair 42 surrounding inner ribbon pair 44. Outer ribbon pair 42 is in the form of a hollow tube surrounding inner ribbon pair 44 and held together by a series of tacking points 46 spaced apart from inner ribbon pair 44. In addition, end tacking point 48 which affixes one end of outer ribbon pair 42 to the end of inner ribbon pair 44 is provided. The pattern of tacking points 46 through outer ribbon pair 42 and the exact shapes of the ribbon pairs determine the appearance of the bow. Such a decorative bow 50 is shown in FIG. 9. This bow is formed when inner ribbon pair 44 is pulled out of the sheath formed by outer ribbon pair 42. Inner ribbon pair 44, when pulled out of the sheath, forms package ribbons 52 and 54 which are then conveniently used to secure decorative bow 50 to box 19 to complete the assembly.

The required length for package ribbons 52 and 54 depends on both the size and dimensions of box 19 when assembled as well as the way in which the ribbon is positioned around the box. The dimensions for the components of pull bow 40 for various box sizes and ribbon arrangements are well known and may easily be determined by those skilled in the art.

Figure 10:
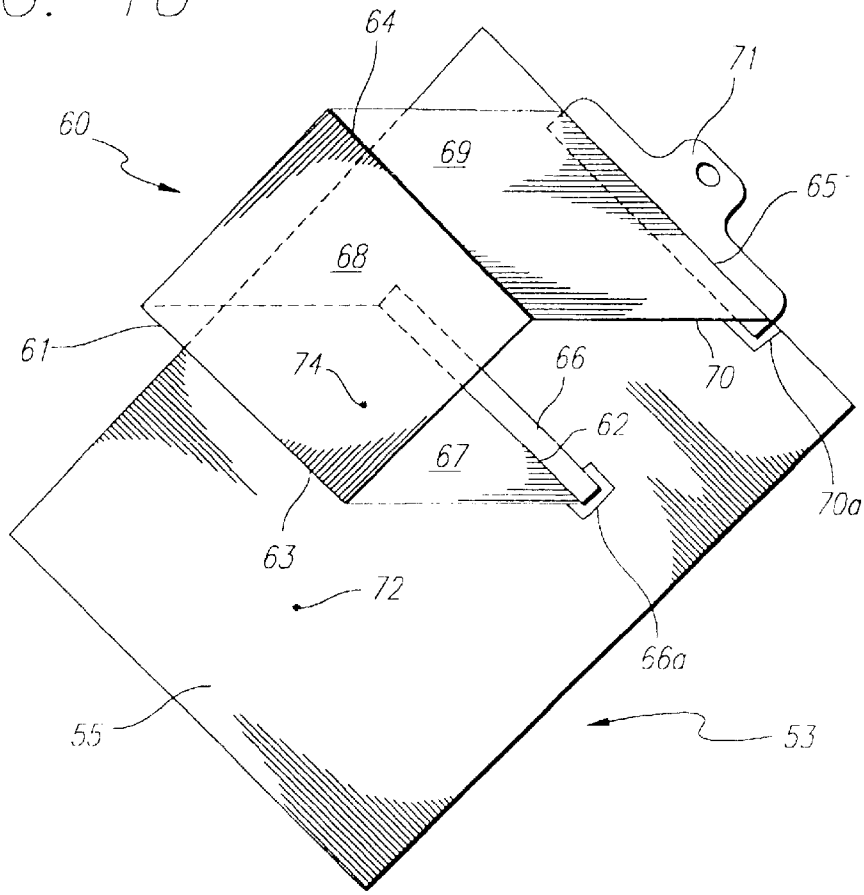
FIG. 10 is an isometric view of a first embodiment of a volume sizer according to the present invention.

Pull bow 40 may be combined in a convenient package with flattened box tube 35 and segments of tape for use as tape segments 22 and 32 to complete a pre-wrapped gift box kit, such as pre-wrapped gift box kit 53 shown in FIG. 10, which may be packaged in a flat condition for shipping, distribution, storage, and display for retail sale. Pre-wrapped gift box kit 53 may be enclosed by clear plastic wrap 55 in order to protect it in shipping and while being displayed in stores.

Referring now also to FIG. 10, a mechanism for evaluating the interior volume of the completed package may be provided in the form of volume sizer 60, a folded and flattened partial box form which may be conveniently attached to the exterior of the clear plastic wrap 55 of pre-wrapped gift box kit 53. The sides of the folded and flattened box of volume sizer 60 are erected to form an open partial box having the same volume and dimensions as the gift box assembled from flattened box tube 35 shown in FIGS. 5 and 6. Volume sizer 60 enables a prospective purchaser of pre-wrapped gift box kit 53 to determine if the item to be wrapped will fit in the completed gift box. The purchaser may then visually compare, and/or physically insert, the gift to be wrapped into open volume sizer 60 to determine the suitability of the pre-wrapped gift box for the gift. In the configuration shown in FIG. 10, this evaluation may be performed without opening pre-wrapped gift box kit 53.

As shown in FIG. 10, a preferred embodiment of volume sizer 60 is manufactured from a generally rectangular sheet of box construction material, such as die cut and creased cardboard 61 or other similarly formed, thin sheet of material suitable for box construction. Folding creases 62, 63, 64 and 65 in cardboard 61 form the lines along which volume sizer 60 is to be folded and define the lengths of the sides of the open partial box volume to be formed. The folding creases divide volume sizer 60 into five sections: a first hinge section 66, a first box side section 67, a central section 68, a second box side section 69, and a second hinge section 70.

Volume sizer 60 may be attached to any convenient base including a store display or the face of pre-wrapped gift box kit 53. In a presently preferred embodiment, volume sizer 60 is attached to the exterior of plastic wrap 55 on the face of pre-wrapped gift box kit 53 by attachment surfaces **66*a* and 70*a* by means of which first hinge section 66, and second hinge section 70, are each affixed to plastic wrap 55 on the face of pre-wrapped gift box kit 53. Second hinge section 70 may be affixed to the exterior of plastic wrap 55 on the face of pre-wrapped gift box kit 53 as shown in FIG. 10, or on the back side (not shown) of pre-wrapped gift box kit 53. Attachment surfaces 66*a* and 70*a*** may conveniently use conventional adhesives such as rubber cement or other suitable bonding material.

Volume sizer 60 may also be provided separately, and/or made detachable from pre-wrapped gift box kit 53, to permit a retailer or other seller of pre-wrapped gift box kit 53, or user of volume sizer 60, to replace dirty or damaged volume sizers as necessary. To make volume sizer 60 conveniently replaceable, attachment surfaces **66*a* and 70*a* for hinge sections 66 and 70 may be made easy to break and re-affix. This may be accomplished by using either VELCRO or a lightly bonding adhesive to make the original attachment and providing a convenient adhesive for reattachment, such as conventional adhesive surfaces on the replacement volume sizer 60** protected by peel away layers, not shown.

In a presently preferred embodiment, volume sizer 60 is attached at the top of pre-wrapped gift box kit 53. Other embodiments include having volume sizer 60 integrated with or attached to header assembly 71 used for hanging pre-wrapped gift box kit 53 in a store, or placing volume sizer 60 on other locations on the face of pre-wrapped gift box kit 53 as will be discussed below in greater detail with regard to FIG. 11.

Additionally, to allow volume sizer 60 to be repeatedly erected and collapsed and still return to a flat state, tacking point 72 may be provided on the exterior of plastic wrap 55. Corresponding tacking point 74, on first box side section 67, is attached to tacking point 72 by a drop of a lightly bonding adhesive or other reusable attachment mechanisms, such as VELCRO pads, may be used. Either arrangement allows the attachment at this tacking point to be easily broken and re-secured, thereby permitting the volume sizer to be repeatedly erected and collapsed and return to its flat state.

Volume sizer 60 is collapsed by folding first box side section 67 along crease 63 so that it is underneath central section 68. When volume sizer 60 is in its collapsed state, first hinge section 66 and first box side 67 lie under central section 68 and second box side section 69. To erect volume sizer 60, second box side section 69 is extended until it is perpendicular to pre-wrapped gift box kit 53 by folding along creases 64 and 65 and breaking the attachment between tacking points 72 and 74. Volume sizer 60 may thereby be erected to extend first box side section 67 until it is perpendicular to the face of pre-wrapped gift box kit 53. In this way, a volume sizer consisting of an open box with two parallel, open ends is formed, with the pre-wrapped gift box kit 53 forming one of the four closed sides.

Figure 11:
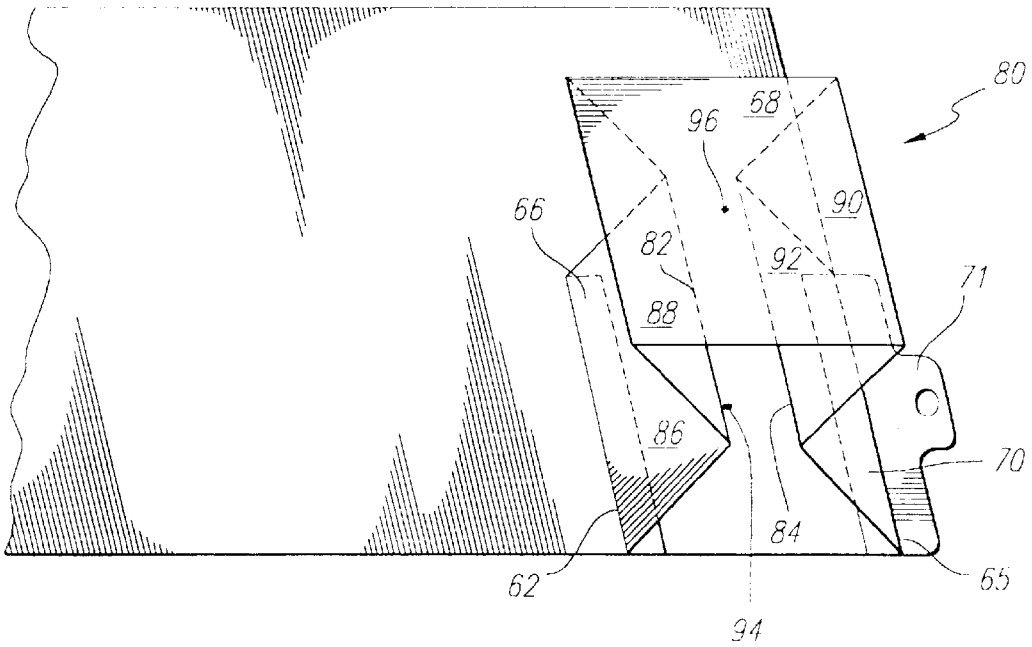
FIG. 11 is an isometric view of another embodiment of a volume sizer according to the present invention.

Referring now to FIG. 11, an alternative embodiment of a volume sizer is shown in the form of accordion volume sizer 80 which includes creases 82 and 84 not present in volume sizer 60 shown in FIG. 10. Such creases allow volume sizer 80 to be erected and collapsed in an accordion-like fashion. The creases further divide accordion volume sizer 80 into first box side lower subsection 86, first box side upper subsection 88, second box side upper subsection 90, and second box side lower subsection 92.

When collapsing accordion volume sizer 80, lower subsections 86 and 92 are folded inward and down so that the outer surfaces of lower subsections 86 and 92 are flush with the outer surfaces of upper subsections 88 and 90 when accordion volume sizer 80 is in its collapsed state. Additionally, when accordion volume sizer 80 is in its collapsed state, the inner surface of central section 68 is flush with the inner surfaces of upper subsections 88 and 90. Further, when accordion volume sizer 80 is in its collapsed state, the inner surfaces of lower subsections 86 and 92 are flush with plastic wrap 55 of pre-wrapped gift box kit 53.

In addition, there may be single or multiple tacking points on accordion volume sizer 80. In a presently preferred embodiment, tacking point 94 on plastic wrap 55 corresponds with tacking point 96 on the inner side of central section 68 as shown in FIG. 11. In addition, multiple tacking points (not shown) may be used and placed where convenient, such as on upper and/or lower subsections 86, 88, 90, and 92.

The volume sizer may be generally centered on the face of pre-wrapped gift box kit 53 as shown in FIG. 10 with regard to volume sizer 60. Alternatively, the volume sizer may be positioned along one edge of pre-wrapped gift box kit 53 as shown in FIG. 11 with regard to volume sizer 80. By positioning the volume sizer along the edge of the kit, the kit may be positioned perpendicularly to a hard surface, such as a store counter top or table top, not shown, so that the hard surface forms an addition side to the open volume sizer box when erected.

Figure 12:
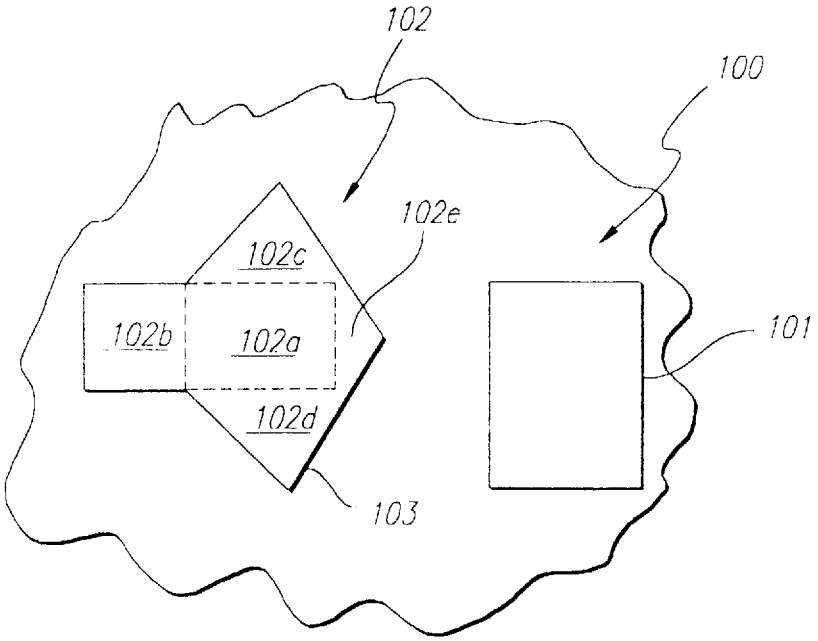
FIG. 12 is a top plan view of a detachable greeting card and envelope according to the present invention.

Referring now to FIG. 12, removable greeting card 100 and a removable envelope 102 for greeting card 100 may be connected to a volume sizer or plastic wrap 55 or other portion of pre-wrapped gift box kit 53. Removable greeting card 100 is removable via perforated detachable border 101, and removable envelope 102 is removable via perforated border 103. Removable envelope 102 consists of a generally rectangular body 102*a* and flaps 102*b*, 102*c*, 102*d*, and 102*e*. Once detached, removable envelope 102 may be assembled by folding flaps 102*b*, 102*c*, 102*d*, and 102*e* across body 102*a* and securing with adhesive.

Figure 13:
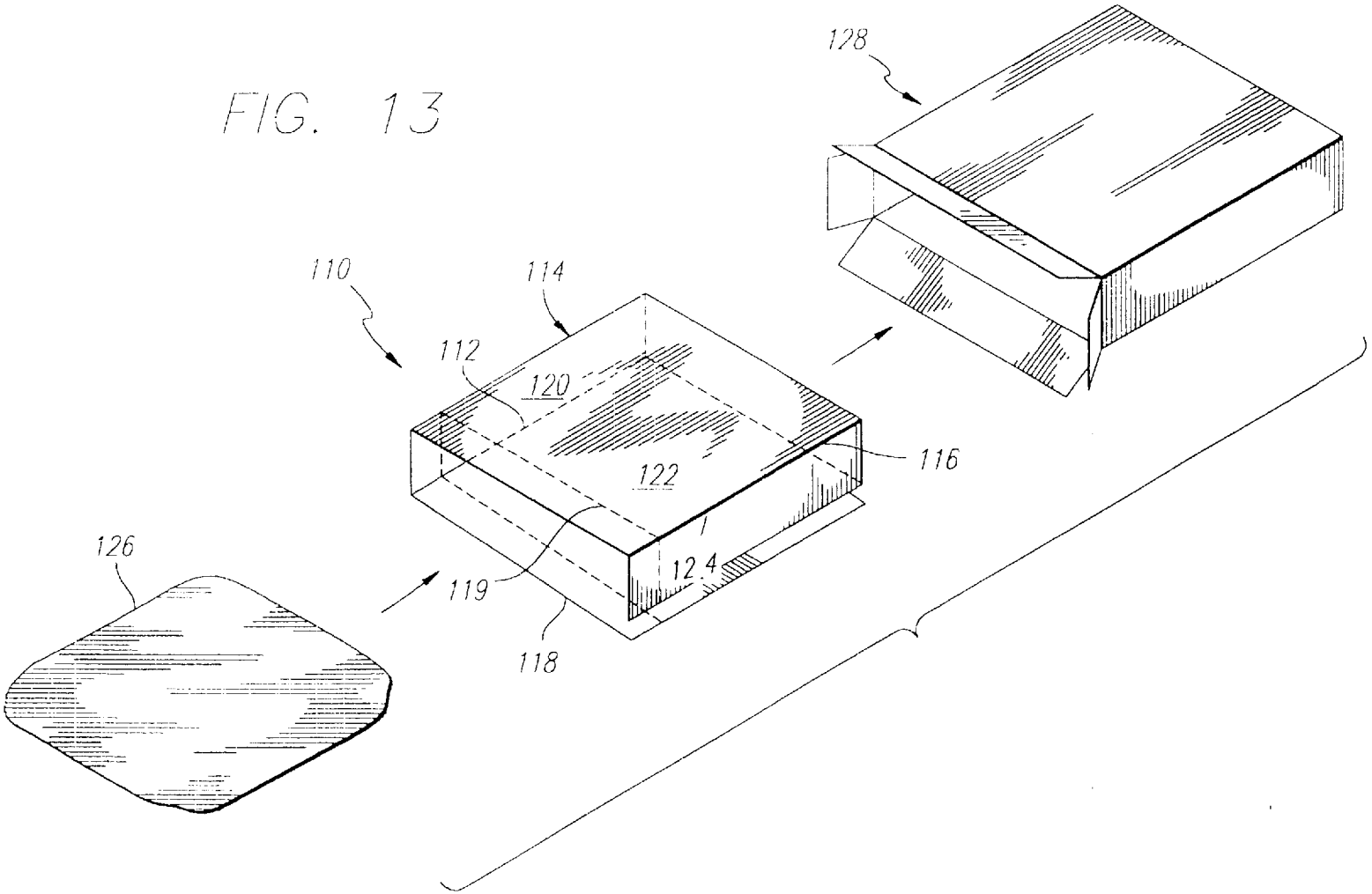
FIG. 13 is an isometric view depicting the relationship between a gift to be packaged, an inner sleeve and a pre-wrapped package according to the present invention.

Referring now to FIG. 13, inner sleeve 110 is provided for use in placing a gift inside a partially assembled pre-wrapped gift box. Inner sleeve 110 may be packaged as a separate item within pre-wrapped gift box kit 53 and thereby used, when removed from pre-wrapped gift box kit 53, either as a volume sizer in the manner of volume sizers 60 and 80 shown in FIGS 10 and 11 respectively, as well as inner sleeve 110.

In particular, inner sleeve 110 is configured from a generally rectangular sheet of box construction material which may be formed from a die cut and creased piece of cardboard or other similarly formed suitable material. Inner sleeve 110 has three creases 112, 114, and 116 which delineate inner sleeve 110 into sleeve panels 118, 120, 122, and 124 with dimensions slightly smaller than the dimensions of the pre-wrapped gift box with which it will be used so that inner sleeve 110 may be inserted into pre-wrapped gift box 128 when both are erected.

Alternatively, inner sleeve crease and size formation markings may be printed on the inside of a volume sizer so that the volume sizer may be cut and/or creased by the purchaser and used as an inner sleeve 110. This dual functionality as both a volume sizer, and as an inner sleeve, reduces cardboard waste.

Where it may be difficult to place a gift inside a partially constructed pre-wrapped gift box, an inner sleeve is placed around the gift so that the inner sleeve and gift can then be easily inserted into the open end of a partially constructed pre-wrapped gift box. If not otherwise already constructed, the user constructs inner sleeve 110 by, for example, folding creases 112, 114, and 116 around gift 126 so that each of the four panels is perpendicular to its immediate neighbor. If inner sleeve 110 is already constructed, gift 126 is placed within inner sleeve 110. In any event, once gift 126 is surrounded by inner sleeve 110, the user inserts the combination of inner sleeve 110 and gift 126 into pre-wrapped gift box 128 with one open end as shown in FIG. 13.

After this combination has been inserted within pre-wrapped gift box 128, inner sleeve 110 may then removed from pre-wrapped gift box 128 before it is closed, if desired.

Inner sleeve 110 may the same length or longer than pre-wrapped gift box 128 with which it will be used. Making inner sleeve 110 longer than pre-wrapped gift box 128 by, for example, about one inch, makes it easier for a user to grab and remove inner sleeve 110 from open ended pre-wrapped gift box 128. If inner sleeve 110 may be constructed so that its length is slightly less than length of pre-wrapped gift box 128, inner sleeve 110 can be left with gift 126 inside pre-wrapped gift box 128 to provide a more stable package, particularly when mailing the package. As shown in FIG. 13, inner sleeve 110 may conveniently be provided with scoring line 119 so that the user may reduce the length of inner sleeve 110 to leave it within the pre-wrapped gift box 128 if desired.

Figure 14:
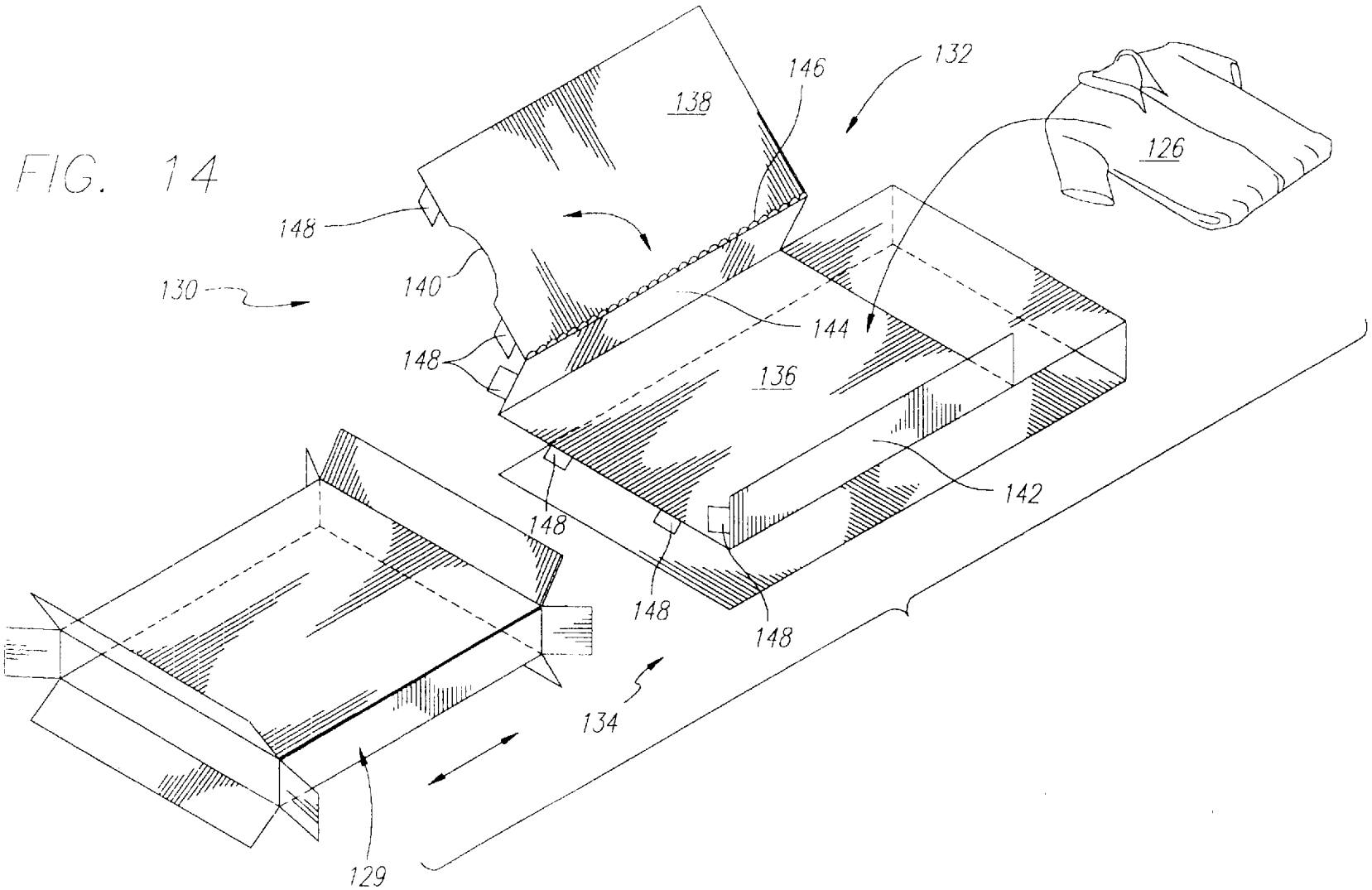
FIG. 14 is an isometric view of a first embodiment of a box loading device according to the present invention shown in an open position for receiving a gift to be packaged and an erected box tube into which the gift is to be loaded.

Referring now to FIG. 14, box loading device 130 may be used in lieu of, or even together with inner sleeve 110, to aid in placing a compressible object such as a shirt or sweater, shown as gift 126, into an open ended, erected pre-wrapped gift box in the form of open ended pre-wrapped gift box 129. Box loading device 130 may be made out of metal, plastic, or other appropriate material. Box loading device 130 includes a compressible object loading compartment in the form of upper gift holding structure 132 and as well as cantilever support 134 which may be fabricated from one or more elements in a conventional manner.

The interior of upper gift holding structure 132 is sized to be slightly smaller than the exterior of open ended pre-wrapped gift box 129, and upper gift holding structure 132 must be supported in a cantilever fashion by cantilever support 134, so that open ended pre-wrapped gift box 129 can easily be slid on and then off of box loading device 130.

More specifically, upper gift holding structure 132 includes four panels. Bottom panel 136 is flat and rectangular. In a presently preferred embodiment, top panel 138 is minimally convex but may be flat or more convex to suit differing applications. Further, top panel 138 contains semicircular cut out 140 along the edge from which a box enclosed gift is pulled. Additionally, bottom panel 136 must be long enough so that open ended pre-wrapped gift box 129 can be slid so that the end of the box's open flaps are flush with the end of the box loading device. Upper gift holding structure 132 also includes side panels 142 and 144 attached to bottom panel 136. Side panel 144 is hinged to top panel 138 by hinge 146. Hinge 146 may be a piano hinge, a plastic hinge added as part of a vacuum molded production process, or any other suitable hinge mechanism.

In addition, guiding flaps 148, preferably fabricated from a smooth material such as plastic, may conveniently be attached to the box receiving edge of top, bottom, and side panels 200, 201, 202, and 203 generally in the positions as shown in FIG. 14. Flaps 148 may be attached by staples, bolts or other conventional fastening devices or included in the structure of as part of the fabrication thereof. Flaps 148 are attached and contoured so that open ended pre-wrapped gift box 129 can easily be slid onto upper gift holding structure 132, supported by cantilever support 134.

In operation, gift 126—which may first be wrapped in tissue paper—is positioned within upper gift holding structure 132 and top panel 138 is closed. Open ended pre-wrapped gift box 129 is then easily slid over guiding flaps 148 onto box loading device 130 to surround upper gift holding structure 132. One end of pre-wrapped gift box 129, together with gift 126, is then grasped at about the location of semicircular cut out 140 to slide pre-wrapped gift box 129, now enclosing gift 126, from upper gift holding structure 132. This technique is particularly useful in loading open ended boxes such as shirt boxes.

Figure 15:
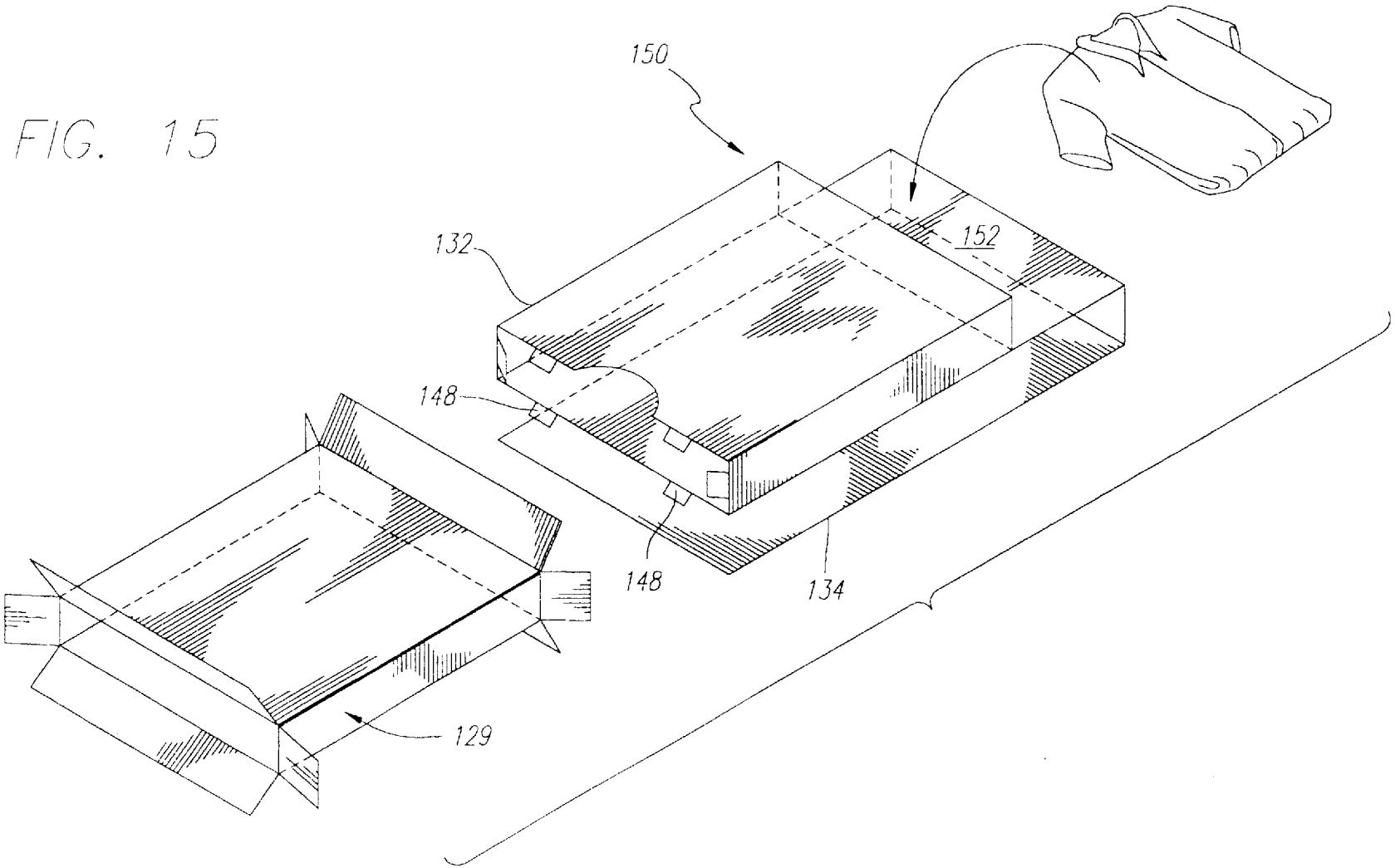
FIG. 15 is an isometric view of an alternative embodiment of a box loading device according to the present invention.

Alternatively, as shown in FIG. 15, box loading device 150 may include upper working surface 152 as part of cantilever support 134 for upper gift holding structure 132 which need not include an opening top as shown in the embodiment described above with respect to FIG. 14. Gift 126 is positioned on upper working surface 152 and for insertion into upper gift holding structure 132 either before or after open ended box 129 is slid onto the exterior of upper gift holding structure 132. Low friction devices such as smooth surfaces and/or rollers (not shown) may be placed on the exterior surfaces of upper gift holding structure 132 to aid in the positioning of open ended pre-wrapped gift box 129 onto upper gift holding structure 132 and its removal therefrom.

Referring now to the embodiments shown in FIG. 16 through 19, the pre-wrapped package may be configured to be top opening so that the gift may be removed therefrom by the recipient by opening the top of the box. The pre-wrapped package is made to appear to the gift recipient to have been top loaded even though it was end loaded by the purchaser. The top opening box configuration further aids in the appearance of a hand wrapped gift and may be used shirts, blouses, sweaters and other articles.

Figure 16:
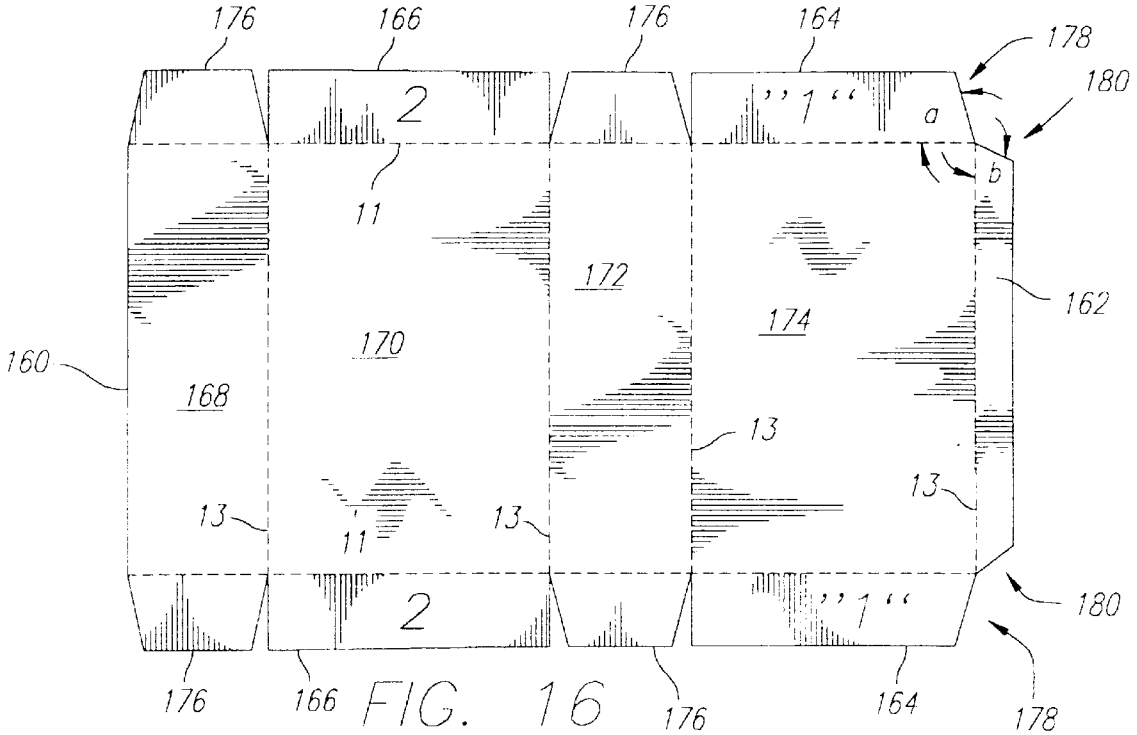
FIG. 16 is a top plan view of a die cut form from which a top opening, pre-wrapped gift box according to the present invention is constructed.

Referring in particular now to FIG. 16, top opening box substrate 160 is generally similar to those described above with regard, for example, to FIG. 1 and includes horizontal or flap creases 11 and vertical or folding creases 13. Top opening box substrate 160 further includes front lip 162 in lieu of end tab 15 shown in FIG. 1 in order to faithfully emulate conventional top opening boxes. Top opening box substrate 160 includes pairs of top end flaps 164, bottom end flaps 166, as well as front panel 168, bottom panel 170, back panel 172, top panel 174, and four side end flaps 176.

Figure 17:
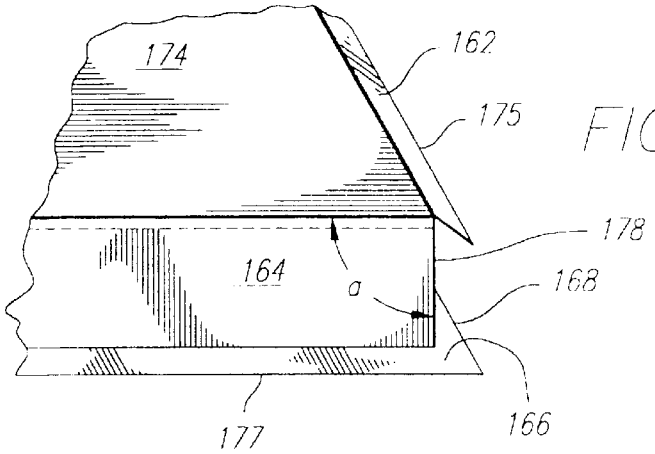
FIG. 17 is an isometric view of a portion of a top opening pre-wrapped gift box according to the present invention showing the angled front edge of the top end flap.

In one embodiment, front edges 178 of top end panels 164 are relieved from the perpendicular, by for example being cut to include acute angle a, so that after assembly, the top opening box formed from substrate 160 may be opened without front edge 178 hitting or otherwise interfering with front panel 168 as illustrated in FIG. 17. Side edges 178 may also be relieved by being cut as an arc of a circle centered at the hinge point of the opening top. Similarly, side edges 180 of front lip 162 are cut to include acute angle b so that front lip 162 may avoid interference when the top of the top opening box formed from top opening box substrate 160 is opened.

Wrapping paper is applied to top opening box substrate 160 to form a pre-wrapped gift box in the same manner described above with regard to the embodiment shown FIGS. 1–4. After the wrapping paper has been attached, a flattened box tube, generally the same as flattened box tube 35 shown in FIGS. 5 and 6, is formed by folding vertical creases 13 and adhering front lip 162 to front panel 168 to form a lap joint therebetween. When a gift is to be packaged, the box tube is erected and gift is inserted with or without the aid of an inner sleeve or other box loading mechanism as described above. However, in order to allow for top opening after the box has loaded and sealed, top end flaps 164 must be folded down first, before bottom end flaps 170 are folded. As illustrated in FIG. 16, top end flaps 164 may be labelled "1" and bottom end flaps 166 labelled "2" for the user's convenience so that the top and bottom end flaps 164 and 166 are folded down in the proper sequence.

Side end flaps 176 are thereafter folded inward to rest on the surface formed by already folded bottom end flaps 166. Side end flaps 176 may be labelled with the numbers "3" and "4", if desired, so that the flaps are folded in a specified sequence, although this is not required. The labelling may conveniently be achieved by die stamping, printing, or other labelling means.

Folding down top end flaps 164 before bottom end flaps 170 results the formation of opening top 175, shown in FIG. 17, including top panel 174, front lip 162 and top end flaps 164. Adhesive tape, or other suitable means, may be pre-applied to the inside of side end flaps 176 during manufacture of flattened box tube 35, to attach a pair of side end flaps 176 to each bottom end flap 166.

After assembly, front panel 168, bottom panel 170, and back panel 172 form a "U" shaped cross sectional form sealed off at each end by a pair of side end flaps 176 adhered to each bottom end flap 166 to form open top box compartment 177. Opening top 175 is attached to open top box compartment 177 by the folding vertical crease 13 between top panel 174 and back panel 172. After assembly, top end flaps 164 are inside of bottom end flaps 166 within open top box compartment 177 and are not attached to side end flaps 176. This permits opening top 175 to be opened upward with ease, providing access to the gift positioned within open top box compartment 177.

In operation, the flattened box tube is first erected. One end of the box is closed by folding one set of end flaps in the sequence described above. A gift may be place into the flattened box tube before the first send of end flaps is folded, or thereafter into the resultant five sided box, the sixth side of which is then formed by folding the remaining set of end flaps also as described above. The wrapping paper may then be folded and sealed to produce an apparently hand-wrapped gift package.

When opened by the gift recipient, however, the gift is not removed by opening the set of end flaps sealed to enclose the gift, but rather by separating front lip 162 from front panel 172 and opening the open top box compartment by lifting the opening top. The appearance of front lip 162 should provide the indication to the recipient that the box is to be opened from the top. This appearance may be enhanced by suitable markings and further evidenced by a substantial difference in the adherence strengths of the end flap bonds and the bond between front lip 162 and front panel 172. That is, the bond between front lip 162 and front panel 172 is intended to be broken easily when the box is opened and need only be strong enough to form the required lap joint during the construction and erection of the box tube. The end flap bond, holding the end flaps together, is not intended to be broken when the box is opened and may therefor be substantially stronger the front lip bond.

Figure 18:
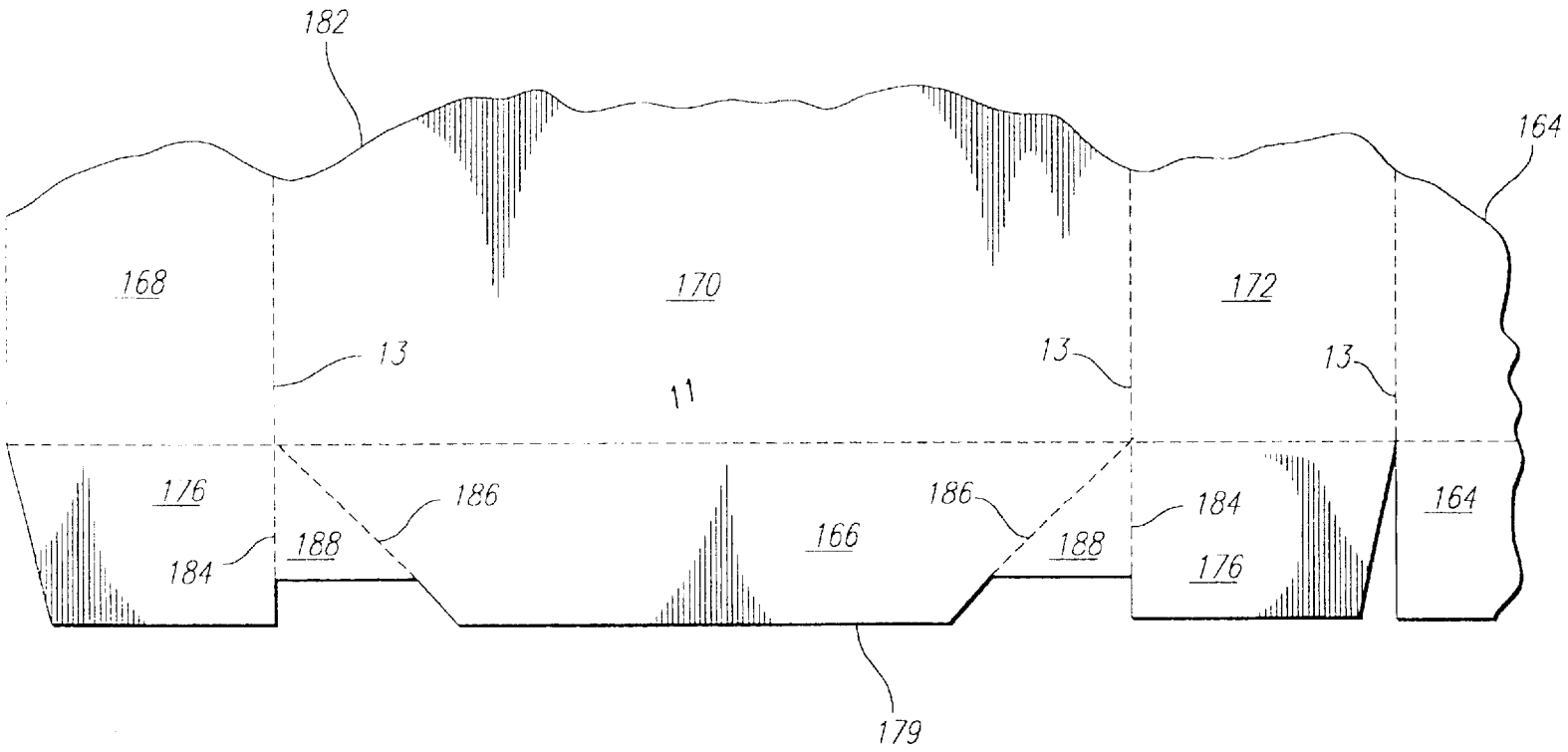
FIG. 18 is a top plan view of the end flaps of an end gathering top opening box according to another embodiment of the present invention.

In an alternate embodiment, as may be understood from the following description with reference to FIG. 18, each set of end flaps is formed from a single, creased end flap 179 which makes assembly more convenient, especially for top opening boxes for shirts and similar sized articles. Gathering ended, top opening box substrate 182 is similar to top opening box substrate 160, of FIGS. 16 and 17, except that each bottom end flap 166 remains joined at each side to one of a pair of side end flaps 176 by one of a pair of creased triangles 188 to form creased end flap 179. Each creased triangle 188 includes side crease 184 between the triangle and a side end flap 176 as well as bottom crease 186 between the triangle and bottom end flap 166. The length of each creased triangle 188, as measured from flap crease 11, may conveniently be made to be shorter than the length of bottom end flap 166 and/or side end flaps 176 to reduce interference.

When erecting and closing gathering ended top opening box 182, top end flaps 164 must be folded down first if a top opening box configuration is used. Each bottom end flap 166 is then folded down over top end flap 164. As each bottom end flap 166 is folded down, side end flaps 176 are pulled inward and downward by the gathering action of the folding of side crease 184 and bottom crease 186 of each triangle 188. By the time that bottom end flap 166 has been folded down to be perpendicular to bottom panel 170, each creased triangle 188 has been folded to be parallel with bottom end flap 166 thereby gathering side end flaps 176 into their operating position, also parallel thereto. Adhesive is used to secure the folded flaps.

If a top opening box is not required, or the crease is configured to break away when the box is opened, another creased triangle 188, positioned between top end flap 164 and side end flap 176 adjacent thereto may be used to also gather in top end flap 164 when bottom end flap 166 is folded.

Figure 19:
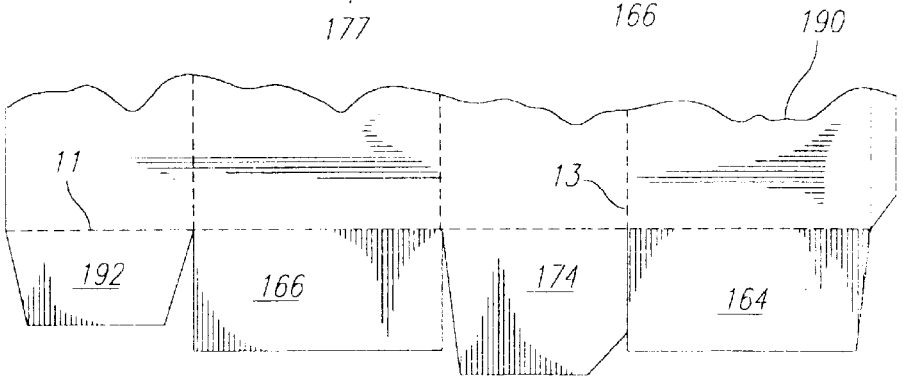
FIG. 19 is a top plan view of the end flaps of an alternate embodiment of a top opening pre-wrapped gift box according to the present invention.

Referring now to FIG. 19, another embodiment of the present invention is described in which top opening box substrate 190 is used to form a top opening box having a relatively square cross section, rather than the rectangular cross section of the shirt sized boxes described above. Top opening box substrate 190 includes bottom end flap 166 and top end flap 164 but each pair of side end flaps 176, as shown for example in FIG. 16, are replaced by shorter, inner side end flap 192 and longer, outer side end flap 194.

In erecting and closing top opening box 190, top end flaps 164 and bottom end flaps 166 must be folded before side end flaps 192 and 194, but it is unimportant whether top end flaps 164 or bottom end flaps 166 are folded first. This makes construction easier for the assembler. After folding top end flaps 164 and bottom end flaps 166, side end flaps 192 and 194 are folded. Inner side end flaps 194 are longer and must be folded before shorter outer side end flaps 192. Outer side end flap 192 may then be attached to inner side end flap 194 any suitable attaching means including tape or other adhesive pre-applied during manufacturing on the outer surface of inner side end flap 194 or on the inner surface of outer minor end flap 192. This sequence of closing the end flaps leaves top and bottom end flaps 164 and 166 unattached thus allowing the box to be opened from the top.

The wrapping paper is then folded over side end flaps 192 and 194 as described above with regard to FIGS. 1–6. Additionally, the wrapping paper flaps are adhered to the wrapping paper adjacent to the outer side end flap 192 by adhesive tape which is pre-applied during manufacturing and located on the wrapping paper near the edge of outer end flaps 192. Alternatively, the adhesive on outer side end flap 194 used to adhere outer end flap 192 thereto may be extended on outer side end flap 194 for additional use in adhering the wrapping paper on non-square boxes.

Figure 20:
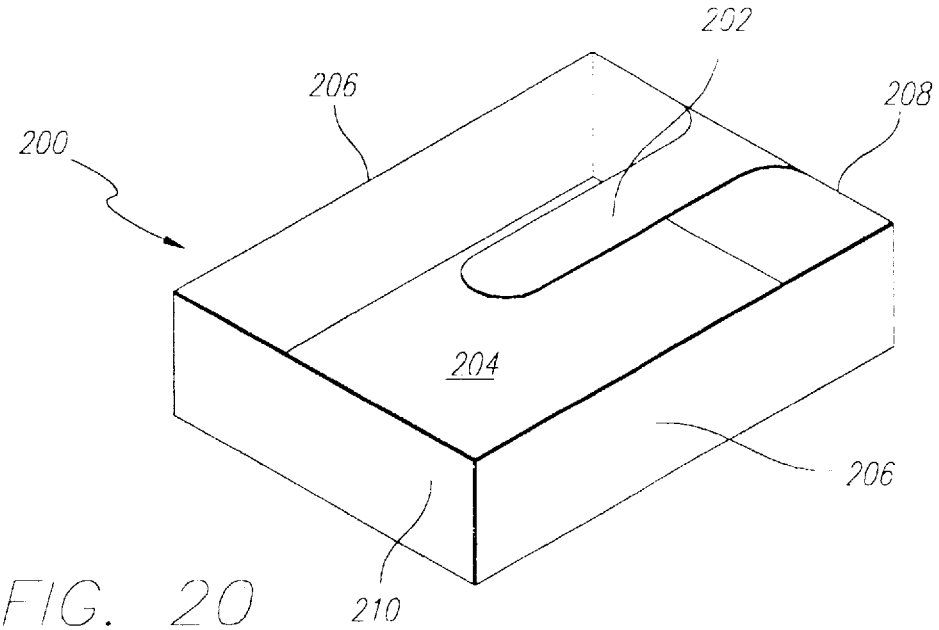
FIG. 20 is an isometric view of an alternate inner sleeve for use in the manner of FIG. 13.

Referring now to FIG. 20, an alternate embodiment of inner sleeve 110 described above with regard to FIG. 13, is shown in which inner sleeve 200 includes compression tongue 202 at the leading edge of inner sleeve 200. Inner sleeve 200 may conveniently be an open top box, such as the common pop-up box, formed from bottom 204, side panels 206 and front and rear panels 208 and 210, respectively. Compression tongue 202 is made of the same material, such cardboard, used for constructing the box and remainder of the inner sleeve and is hinged mounted to the upper edge of front panel 208.

In operation, inner sleeve 200 is erected and the gift placed inside. Thereafter, compression tongue 202 is folded over to help compress the gift during insertion of inner sleeve 200 into the box. The process of inserting inner sleeve 200 into the box may well serve to accomplish or complete the folding over of compression tongue 202 and the compression of the gift for ease of insertion. Inner sleeve 200 may conveniently be held by rear panel 210 while front panel 208 is inserted into the box first.

Having now described the invention in accordance with the requirements of the patent statutes, those skilled in this art will have no difficulties making changes and modifications in the embodiment of the individual elements of the invention in order to meet their specific requirements or conditions. Such changes and modifications may be made without departing from the scope and spirit of the invention as set forth in the following claims.

What is claimed is:

1. The method of making a side loading, top opening pre-wrapped gift box comprising the steps of:

forming a box substrate having front, bottom, back and top panels in which pairs of panels, the front and bottom panels, the bottom and back panels, and the back and top panels being connected to each other along one edge by a bendable vertical crease and having a pair of front flaps, a pair of bottom flaps, a pair of back flaps and a pair of top flaps, each flap of said pair connected to the front, bottom, back and top panels respectively along one opposing edge by a bendable horizontal crease, said horizontal creases being transverse to said vertical creases;

detachably connecting a front lip, connected to the top panel along one edge by a bendable crease, to a surface of the front panel to form a box tube, said detachably connecting being sufficiently easily detachable to permit convenient top opening of a box formed from said box tube;

adhering decorative paper wrapper about said box tube; and applying adhesive to the substrate for connecting one of the front, bottom and back flaps of each pair to form a box end during box loading and not connecting the top flap thereto in order to permit the top flap to easily be removed from said box end during top opening by rotating the top panel about the bendable vertical crease connecting the top panel to the back panel.

2. The invention of claim 1, further comprising the step of:

relieving a side of the front lip to permit top opening by rotating the top panel along the bendable crease connecting the top and back panels without interference between the front lip and the decorative paper wrapped about the box tube.

3. The invention of claim 1, further comprising the step of:

relieving a side of each top flap to permit top opening by rotating the top panel along the bendable crease connecting the top and back panels without interference between the top flaps and the front panel.

4. The invention of claim 3, further comprising the step of:

interconnecting the bottom flap at each box end with the front and back flaps at that box end so that folding the bottom flap to form the box end causes the front and back flaps at that box end to be closed therewith.

* * * * *